US005445760A

United States Patent [19]

Pollack

[11] Patent Number: 5,445,760

[45] Date of Patent: Aug. 29, 1995

[54] POLYSACCHARIDE COATED ELECTRORHEOLOGICAL PARTICLES

[75] Inventor: Robert A. Pollack, Highland Heights, Ohio

[73] Assignee: The Lubrizol Corporation, Wickliffe, Ohio

[21] Appl. No.: 227,770

[22] Filed: Apr. 14, 1994

[51] Int. Cl.[6] ..... C10M 171/00; C09K 3/00

[52] U.S. Cl. ..... 252/73; 252/74; 252/572

[58] Field of Search ..... 252/572, 73, 74

[56] References Cited

U.S. PATENT DOCUMENTS

| | | | |
|---|---|---|---|
| 3,992,558 | 11/1976 | Smith-Johannsen | 427/213 |
| 4,992,192 | 12/1991 | Ahmed | 252/73 |
| 5,073,282 | 12/1991 | Ahmed | 252/77 |
| 5,213,895 | 5/1993 | Hirai et al. | 428/403 |

FOREIGN PATENT DOCUMENTS

| | | |
|---|---|---|
| 394049 | 10/1990 | European Pat. Off. . |
| 427520 | 5/1991 | European Pat. Off. . |
| 2530694 | 1/1976 | Germany . |
| 63-97694 | 4/1988 | Japan . |
| 64-6093 | 1/1989 | Japan . |
| 335095 | 2/1991 | Japan . |
| 3-84095 | 4/1991 | Japan . |
| 3119098 | 5/1991 | Japan . |
| 3192195 | 8/1991 | Japan . |
| 9000583 | 1/1990 | WIPO . |

OTHER PUBLICATIONS

"Xantham Gum–Natural biogum for scientific water control," copyright 1988 and 1992 by Merck & Co., Inc. No Month Available.

*Primary Examiner*—Christine Skane

*Attorney, Agent, or Firm*—David M. Shold; Frederick D. Hunter, Sr.

[57] ABSTRACT

An electrorheological fluid having good shear stress and improved (reduced) conductivity comprises a hydrophobic liquid phase and, dispersed therein, electrorheologically active particles of a core particle with a coating of at least one polysaccharide which is dispersible in a protic medium.

24 Claims, No Drawings

POLYSACCHARIDE COATED ELECTRORHEOLOGICAL PARTICLES

BACKGROUND OF THE INVENTION

The present invention relates to treated particles suitable for use in electrorheological fluids and electrorheological fluids containing such particles.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

The prior art teaches the treatment of fine particles with surface coatings of various types in order to impart some particularly desired property to the particles. For example, U.S. Pat. No. 5,213,895, Hirai et al., May 25, 1993, discloses a particle-bearing composite comprising a solid carrier and polymer-protected particles adsorbed thereon. Colloidal metallic or metal compound particles have adsorbed on them a protective polymer which can be, among other materials, gelatin, sodium casein, and gum arabic.

PCT publication WO 90/00583, Jan. 25, 1990, discloses an electroviscous fluid comprising electrically polarizable aggregate particles dispersed in a dielectric fluid. A substantial portion of the aggregate particles comprise a core and an electrically insulative shield. The shield can be e.g. a resin, a plastic foam, or a ceramic glaze.

Japanese publication 64-6093, also referred to as 1-6093, Jan. 10, 1989, discloses an electroviscous fluid comprising an oily medium and dielectric fine particles consisting of a conductive particle coated with an electric insulating film having 1 μm or less thickness, and containing no water substantially. Representatives of the insulating materials include organic synthetic polymers, organic natural polymers, inorganic compounds such as silica, alumina, aluminum hydroxide, barium titanate and the like.

SUMMARY OF THE INVENTION

The present invention provides an electrorheological fluid comprising a hydrophobic liquid phase and, dispersed therein, electrorheologically active particles comprising a core particle and a coating of at least one polysaccharide which is dispersible in a protic medium.

The invention further provides a method for reducing the electrical conductivity of particles, comprising the steps of combining the particles, a polysaccharide which is dispersible in a protic medium, and a sufficient amount of a protic medium to disperse the polysaccharide and provide a slurry, and removing substantially all of the solvent to provide a solid.

The invention also provides a clutch, valve, shock absorber, or damper containing such an electrorheological fluid.

DETAILED DESCRIPTION OF THE INVENTION

The first component of the present electrorheological fluids is a hydrophobic liquid phase, which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid. Suitable liquids include those which have a viscosity at room temperature of 1 to 300 or 500 centistokes, or preferably 2 to 20 or 50 centistokes. Mixtures of two or more different non-conducting liquids can be used for the liquid phase. Mixtures can be selected to provide the desired viscosity, pour point, chemical and thermal stability, component solubility, etc.

Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal stability, to prevent degradation on storage and service.

Silicon-based oils such as the polyalkyl-, polyaryl-, polyalkoxy-, or polyaryloxysiloxane oils and silicate oils comprise a particularly useful class of synthetic hydrophobic liquids. Examples of silicate oils include tetraethyl silicate, tetraisopropyl silicate, tetra-(2-ethylhexyl) silicate, tetra-(4-methyl-2-ethylhexyl) silicate, and tetra-(p-tert-butylphenyl) silicate. The silicone or siloxane oils are useful particularly in ER fluids which are to be in contact with elastomers. The selection of other silicone-containing fluids will be apparent to those skilled in the art.

Among the suitable vegetable oils for use as the hydrophobic liquid phase are sunflower oils, including high oleic sunflower oil available under the name Trisun TM 80, rapeseed oil, and soybean oil. By way of example, one of the suitable esters is di-isodecyl azelate, available under the name Emery TM 2960. Another illustrative fluid is hydrogenated poly alpha olefin, available under the name Emery TM 3004. Examples of other suitable materials for the hydrophobic liquid phase are set forth in detail in PCT publication W093/14180, published Jul. 22, 1993.

The second component of the present invention is electrorheologically active particles, which are dispersed in the hydrophobic liquid phase. The particles comprise a core particle and a coating of at least one polysaccharide which is dispersible in a protic medium.

The core particle can be any particle which exhibits electrorheological activity. Many ER active solids are known, and any of these, as well as their equivalents, are considered to be suitable for use in the ER fluids of the present invention. The particles are preferably conductive or semiconductive materials, and are especially preferably materials which are capable of exhibiting electrorheological activity when they are substantially anhydrous. The preferred core particles are polymeric materials.

One preferred class of ER active solids suitable for use as the core particles includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice$^{TM}$ NT-013. Amorphous cellulose is also useful in the present invention; examples of amorphous cellulose particles are CF1, CF11, and CC31, available from Whatman Specialty Products Division of Whatman Paper Limited, and Solka-Floc TM available from James River Corp. Other cellulose derivatives include ethers and esters of cellulose, including methyl cellulose, ethyl cellulose, hydroxyethyl cellulose, hydroxypropyl cellulose, sodium carboxymethyl cellulose, cellulose propionate, cellulose butyrate, cellulose valerate, and cellulose triacetate. Other cellulose derivatives include cellulose phosphates and cellulose reacted with various amine compound. Other cellulosic materials include chitin, chitosan, chondrointon sulfate, and viscose or cellulose xanthate. A more detailed listing of suitable cellulosics is set forth in PCT publication WO93/14180.

In another embodiment, the ER active solid particles are particles of organic semiconductive polymers such as oxidized or pyrolyzed polyacrylonitrile, polyacene quinones, polypyrroles, polyphenylenes, polyphenylene oxides, polyphenylene sulfides, polyacetylenes, polyvinylpyridines, polyvinylpyrrolidones, polyvinylidene halides, polyphenothiazines, polyimidazoles, and preferably polyaniline, substituted polyanilines, and aniline copolymers. Compositions of the above and related materials, treated or doped with various additives including acids, bases, metals, halogens, sulfur, sulfur halides, sulfur oxide, and hydrocarbyl halides can also be employed. A more detailed description of certain of these materials can be found in PCT publications WO93/07243 and WO93/07244, both published Apr. 15, 1993. A preferred organic polymeric semiconductor is polyaniline, particularly the polyaniline prepared by polymerizing aniline in the presence of an oxidizing agent (such as a metal or ammonium persulfate) and 0.1 to 1.6 moles of an acid per mole of aniline, to form an acid salt of polyaniline. The polyaniline salt is thereafter treated with a base to remove some or substantially all of the protons derived from the acid. A more complete description of polyaniline and its preferred method of preparation is set forth in PCT publication WO93/07244, published Apr. 15, 1993. The aniline polymer can be the homopolymer or any of a number of copolymers or modified polymers such as a sulfonated aniline/o-toluidine copolymer.

Inorganic materials which can be suitably used as ER active particles include carbonaceous powders, metals, semiconductors (based on silicon, germanium, and so on), barium titanate, chromic oxide, silver germanium sulfide, ceramics, copper sulfide, carbon particles, silica gel, magnesium silicate, alumina, silica-alumina, pyrogenic silica, zeolites, and the like. These can be in the form of solid particles or, in certain cases, hollow microspheres, the latter being available from, i.a., PQ corporation of Valley Forge, PA. Microspheres include hollow ceramic microspheres, 10–100 μm, containing up to 5% crystalline silica (Extendospheres$^{TM}$ SF-14) and silvercoated ceramic microspheres, 10–75 μm (Metalite TM Silver SF-20).

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenol-formaldehyde polymers. Especially preferred is a polymer comprising an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Most preferably this material is a 1:1 molar alternating copolymer of styrene and maleic acid, the maleic acid being partially in the form of the sodium salt. This material is described in more detail in PCT publication WO93/22409, published Nov. 11, 1993.

Other materials which can be used as ER active solid particles include fused polycyclic aromatic hydrocarbons, phthalocyanine, flavanthrone, crown ethers and salts thereof, including the products of polymeric or monomeric oxygen- or sulfur-based crown ethers with quaternary amine compounds, lithium hydrazinium sulfate, and ferrites.

Certain of the above-mentioned solid particles are customarily available in a form in which a certain amount of water or other liquid polar material is present. This is particularly true for polar organic particles such as cellulose or ionic polymers. These liquid polar materials need not necessarily be removed from the particles, but they are not generally required for the functioning of the present invention. The acceptable amounts of such liquid polar material is discussed in more detail below.

The particles used in the ER fluids of the present invention can be in the form of powders, fibers, spheres, rods, core-shell structures, etc. The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device. Since the final particles of this invention consist of the core particle plus a coating, the size of the core particle should be correspondingly somewhat smaller than the desired size of the final particle.

The electrorheologically active particles of the present invention further comprise a coating of at least one polysaccharide which is dispersible in a protic medium. The term "coating" is used herein to mean a material which is associated with or adhered to the outer portion of a core particle. The coating will preferably substantially surround the core particle, and in some cases will even completely envelop the core particle. But in other instances the coating may cover only a portion of the core. Moreover, the extent of coverage of each of the multitude of particles in a particular sample need not be identical. What is more important is that the coating is associated with the core particles in such a manner that it is not readily inadvertently washed off or removed by handling and that it is present in a sufficient amount to improve the properties of the electrorheological fluid. In most cases the presence of the coating will reduce the conductivity of the fluid; it often also lowers the bulk viscosity of the blend and in some cases it even may increase its shear stress. Normally the coating material will comprise 1 to 40 percent by weight of the total electrorheologically active particles (including core particle plus coating), preferably 2 to 20 percent, and most preferably 3 to 15 percent by weight.

Suitable polysaccharides are those which are dispersible in a protic medium. That is to say, they can be dissolved, emulsified, suspended, or otherwise dispersed in a medium such as water, an alcohol, or an amine, phenol, carboxylic acid, other protic solvents, or mixtures thereof. It is by means of dispersion in-such a medium that the polysaccharide is normally coated onto the core particles. It is also preferably that they have a melting point of and are otherwise stable to decomposition at at least 140° C., in order to provide useful properties at the temperature extremes encountered in some electrorheological applications.

Polysaccharides are high molecular weight ($3\times10^4$ to $4\times10^8$) carbohydrates. Typical examples are starch, glycogen, cellulose, dextrans, pectins and pectic acids, chitin, inulin, alginic acid, agar, hemicelluloses, plant gums, mucilages, immunopolysaccharides, and hyaluronic acid. Also included are chemical derivatives of any of the above materials, including cellulose esters such as cellulose acetate, and cellulose ethers including carboxymethylcellulose, which can be prepared by the reaction of alkali cellulose with sodium chloroacetate. Formation of such derivatives are often useful and may be necessary in order to convert a specific polysaccharide (such as cellulose) into a tractable or dispersible form. Each of these materials are well known and are described in detail in standard textbooks such as Noller's "Chemistry of Organic Compounds," 3rd edition, 1965, pages 422 et seq.

The preferred polysaccharides are gums. Gums, also referred to as plant gums or natural gums, are substances which generally dissolve in water, but not in organic solvents, to give mucilaginous solutions or gels. They are typically at least partially in the form of a salt and preferably have a number average molecular weight of $5\times10^5$ to $5\times10^6$. Typical gums include gum arabic, karaya gum, guar gum, mesquite gum, damson gum, gum tragacanth, agar, algin, carrageenan, gum ghatti, seed gums, locust bean gum, psyllium seed gum, quince seed gum, lard gum, pectin, dextran, tamarind gum, and xanthan gum, which is particularly useful. Xanthan gum is believed to be a salt of a polysaccharide having a cellulose backbone with side chains of mannose units and glucuronic acidunits, and is a mixed sodium, potassium, and calcium salt. It has a reported molecular weight of 2–12 million and a melting point of about 160° C. It is normally produced by aerobic submerged fermentation using the bacterium Xanthomonas campestris and is recovered from the fermentation broth by alcohol precipitation. Xanthan gum and its preparation is described in greater detail in "Xanthan Gum: Natural biogum for scientific water control," fourth edition, 1988, Kelco Division, Merck & Co., Inc.

The coating is applied to the core particles by a process including combining the electrorheologically active core particles with a polysaccharide which is dispersible in a protic medium and a sufficient amount of a protic medium to disperse the polysaccharide and provide a slurry, and then removing substantially all of the protic medium to provide solid particles. In a preferred case the core particles are a polymeric material such as polyaniline, the polysaccharide is a gum such as xanthan gum, which is soluble in water, and water (preferably distilled water) serves as the protic medium. Other materials, however, can serve as the protic medium, such as alcohols, including particularly glycerol and ethylene glycol, as well as many acids and bases. Media which can be readily removed, such as by evaporation or filtration and drying, are preferred. Media in which the polysaccharide is soluble, either upon heating or, especially, at room temperature, are also preferred.

In a preferred embodiment, the core particles are dried before coating and are mixed with dry particles of the coating material in the desired ratio. The combined solids are stirred in water, normally using 1 L of water per 100 g of solids. The temperature, stirring rate, and stirring time are adjusted to provide for dispersion or solution of the coating material and suspension of the particles (which preferably will be insoluble in the water or other protic medium). After mixing, the composition can be in the form of a gel-like material or a liquid; the excess water is removed by appropriate means such as by heating or vacuum drying. While normally filtration methods would be unsuitable for working with a gelatinous material, it is possible that for some combinations of polysaccharide coating materials and protic media, filtration would prove useful. Typically the aqueous material is dried by placing it into a ball mill jar containing grinding media and the jar placed into a forced air oven at elevated temperature (e.g. 65°–95° C.) for several hours to remove most of the water. (A temperature in excess of the boiling point of the protic medium could even be used, provided that suitable provision is made to avoid physical loss of sample through uncontrolled boiling.)

After substantially all of the protic medium is removed from the composition, a solid material is obtained which may be the form of large particles or lumps. If this is the case, the solid material is comminuted or ground to provide particles of the desired size. If, as described above, the material is dried in a ball mill jar already containing grinding media, the jar can be closed and rolled on a ball mill for a suitable length of time, e.g. several minutes to several days, normally several hours, to obtain a dry powder. Other methods of grinding the material can be used, including use of a mortar and pestle, either manually or through an automated version, or use of an attriter, a beater mill, or an ultra centrifugal mill. The ground materials can be passed through a sieve, if desired, to remove any large particles. After this treatment the particles will normally have a size and shape approximately corresponding to that of the electrorheologically active core particles, taking into account the presence on each particle of coating material.

The electrorheological fluids of the present invention can be prepared by admixing the above-described particles with base fluid and any other desired components (described below) in appropriate concentrations. Such mixing should preferably be of sufficient thoroughness to provide a well-dispersed mixture of particles in the inert fluid. This mixing can be accomplished by any of a variety of well-known methods, including stirring or shaking by hand or by mechanical means, the use of a ball mill a dispersator, a Waring TM blender, an attriter, or by ultrasonic mixing. The method used will depend on the nature of the particle. Certain metal-coated microspheres, for instance, are very fragile and are preferably admixed by stirring or shaking of the fluid. Blending will be conducted for a period of time sufficient to achieve the desired degree of uniformity, which may require several hours, depending on the equipment selected.

The ER fluid may also contain other typical additives. Dispersants are often desirable to aid in the dispersion of the particles and to minimize or prevent their settling during periods of non-use. Such dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in PCT publication WO93/14180, published Jul. 22, 1993and include e.g. hydroxypropyl silicones, aminopropyl silicones, mercaptopropyl silicones, and silicone quaternary acetates. Other dispersants include acidic dispersants, ethyoxylated nonylphenol, sorbitan monooleate, basic dispersants, sorbitan sesquioleate, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxy-polyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, and tertiary amines.

The composition of the present invention can further contain other additives and ingredient which are customarily used in such fluids, including antioxidants and antiwear agents. Most importantly, it can contain a polar activating material other than the aforementioned components.

As has been mentioned above, certain of the ER-active particles, such as cellulose or polymeric salts, commonly have a certain amount of water associated with them. This water can be considered such a polar activating material. The amount of water present in the compositions of the present invention is typically 0.1 to 30 percent by weight, based on the solid particles. More generally the amount of polar activating material (which need not be water) will be 0.1 to 10 percent by weight, based on the entire fluid composition, preferably 0.5 to 4%, and most preferably 1.5 to 3.5 weight percent, based on the fluid. The polar activating material can be introduced to the ER fluid as a component of the solid particles (such as absorbed water), or it can be separately added to the fluid upon mixing of the components. Whether the polar activating material remains dispersed through the bulk of the ER fluid or whether it associates with the solid particles is not precisely known in every case, but such details are not essential to the functioning of the present invention. Indeed, even the presence of a polar activating material is not essential to the functioning of the fluids of the present invention or to the dispersant characteristics of the surfactant. Rather it is observed that some ER fluid systems function more efficiently when the polar activating material is present. For example, it is sometimes desirable not to dry cellulose thoroughly before it is used in the ER fluids of the present invention. On the other hand, for fluids which will be exposed to elevated temperatures during their lifetime, it is often desirable that no water or other volatile material be present. Moreover, it may be undesirable to have significant amounts of water present if the coating material will interact unfavorably with the water, e.g. by dissolving. For such applications the use of an alternative polar material, having significantly lower volatility and reduced affinity for the coating material, can be useful.

Suitable polar activating materials can include water, other hydroxy-containing materials as alcohols and polyols, including ethylene glycol, glycerol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, 2-(2-hexyloxyethoxy)ethanol, and glycerol monooleate, as well as amines such as ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like.

While the polar material is believed to be normally physically adsorbed or absorbed by the solid ER-active core particles, it is also possible to chemically react at least a portion of the polar material with the core polymer. This can be done, for example, by condensation of alcohol or amine functionality of certain polar materials with an acid or anhydride functionality on the polymer or its precursor. Such treatment would normally be effected before the coating material is applied to the core particles.

The relative amounts of the components of the present invention are not strictly limited to any numerical quantities but include all amounts for which the composition exhibits electrorheological properties, and in particular those amounts of core material and coating material for which the fluid retains electrorheological activity while exhibiting reduced bulk electrical conductivity.

The amount of the hydrophobic base fluid is normally the amount required to make up 100% of the composition after the other ingredients are accounted for. Often the amount of the base fluid is 10–94.9 percent of the total composition, preferably 36–89 percent, and most preferably 56–79 percent. These amounts are normally percent by weight, but if an unusually dense dispersed solid phase is used, it may be more appropriate to determine these amounts as percent by volume.

Similarly, the amount of the electrorheologically active composite particles in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the particles normally impart at least a slight degree of conductivity to the total composition. For most practical applications the particles will comprise 1 to 80 percent by weight of the ER fluid, preferably 5 to 60 percent by weight, more preferably 10 to 50 percent by weight, and most preferably 15 to 35 percent by weight. Of course if the nonconductive hydrophobic fluid is a particularly dense material such as carbon tetrachloride or certain chlorofluorocarbons, these weight percentages could be adjusted to take into account the density. Determination of such an adjustment would be within the abilities of one skilled in the art.

Within the particle component, the relative amounts of the core electrorheologically active particles and the coating material should normally be such that the coating material comprises 1 to 40 percent by weight of the total particle component. Preferably the coating material will comprise 2 to 20 percent of the particles, and more preferably 3 to 15%. At lower amounts of coating the reduction (improvement) in conductivity of the electrorheological fluid is less pronounced, while with higher amounts there is little additional advantage observed, and indeed the electrorheological activity can be reduced somewhat as the proportion of the particle comprising the active core is reduced.

The amount of the optional dispersant component in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

The ER fluids of the present invention find use in clutches, valves, dampers, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

EXAMPLES

Example 1

Polyaniline, prepared substantially according to the method disclosed in PCT publication WO93/07244, including extensive washing with base followed by oven drying, is used as the core material. To obtain 100 g of a coated product with 5% xanthan gum coating, 95 g of the polyaniline and 5 g xanthan gum are mixed with 500 g distilled water. The mixture is blended using a Waring TM high speed blender for 3 minutes. The mixture is poured into a drying dish and heated to 90°–100° C. until the mixture has solidified. The solids are dry milled for 24 hours, and the resulting powder is passed through a sieve with a 710 μm screen. The resulting powder is vacuum dried at 150° C. for 17 hours.

The dried composite powder, 25 g, is compounded to a fluid for electrorheological testing by combining on a ball mill with 96.35 g of a 10 cSt silicone base fluid and 3.75 g of a functionalized silicone dispersant (EXP 69 OH TM) for 24 hours.

Example 2

Polyaniline, prepared as in Example 1, 48 g, is mixed with 12 g xanthan gum in 2 L distilled water. Mechanical mixing is effected with a glass stirring rod at slow speed for 3 hours. The water is removed by evaporation by predrying at 90° C. in a forced air oven for about 3 days. The solids obtained are sieved through a 710μm screen and dried under vacuum at 150° C.

The dried powder is compounded into an electrorheological fluid substantially as in Example 1.

Examples 3–13

The procedures of Examples 1 and 2 are substantially repeated except that the amount of xanthan gum is adjusted to provide coating levels of 0.5 to 10%, including reference examples prepared without coating. In some instances the concentration of the solid particles in the ER fluid is varied, as shown in Table I.

Certain of the fluids prepared above are tested to measure current density (in $mA/m^2$) and shear stress (in kPa at 20,000 $sec^{-1}$ shear rate) at 6 kV/mmelectric field. The fluids are tested in an oscillating duct flow device. This device pumps the fluid back and forth through parallel plate electrodes. The shear stress is determined by measuring the force required to move the fluid through the electrodes. The mechanical amplitude is ±1 mm and the electrode gap is 1 mm. The mechanical frequency range is 0.5 to 30 Hz, which produces a shear rate range of 600 to 36,000 $sec^{-1}$. The shear rate is calculated at the wall of the electrodes assuming Poiseuille flow. This device is described in greater detail in PCT publication W093/22409, published Nov. 11, 1993. The results of testing are reported in Table I (Examples using different batches of polyaniline are grouped together.)

TABLE I

| Ex. | % Coating | Particle conc., % | Temp. °C. | Current Density | Shear Stress |
|---|---|---|---|---|---|
| 3 | 0 | 20 | 20 | 800 | 6 |
| | | | 80 | 1300 | 2.6 |
| 4 | 5 | 20 | 20 | 101 | 6.8 |
| | 80 | 398 | 4.5 | | |
| 5 | 10 | 20 | 20 | 88 | 6.9 |
| | | | 80 | 122 | 3.9 |
| 6 | 0 | 20 | 20 | 485 | 7.5 |
| | | | 80 | 4022 | 6.8 |

TABLE I-continued

| Ex. | % Coating | Particle conc., % | Temp. °C. | Current Density | Shear Stress |
|---|---|---|---|---|---|
| 7 | 2.5 | 20 | 20 | 23 | 4.4 |
| | | | 80 | 51 | 2.4 |
| 8 | 2.5 | 25 | 20 | 45 | 6.8 |
| | | | 80 | 252 | 5.4 |
| 9 | 5 | 20 | 20 | 29 | 5.8 |
| | | | 80 | 82 | 3.1 |
| 10 | 5 | 25 | 20 | 37 | 6.8 |
| | | | 80 | 112 | 3.4 |
| 11 | 0 | 20 | 20 | 52 | 5.7 |
| | | | 80 | 254 | 3.4 |
| 12 | 0.5 | 20 | 20 | 39 | 6 |
| | | | 80 | 182 | 3.2 |
| 13 | 1 | 20 | 20 | 36 | 4.2 |
| | | | 80 | 168 | 2.1 |

The results show that adding a gum coating to conductive polymeric particles leads to reduced current density with comparable shear stress.

Example 14

Polyaniline from Allied-Signal (Versicon TM), washed with base, 33.25 g, is mixed with 1.75 g xanthan gum and 700 g distilled water in a Waring TM blender. The composition is mixed for 2 minutes on "slow," followed by 2 minutes on "fast." The resulting mixture is poured into a pyrex dish, predried for 24 hours at 70° C., then finally dried for 24 hours at 150° C. under vacuum. The product is compounded into an electrorheological fluid containing 25% solids. A screening test indicates that the material has a high conductivity, which presumably reflects the very high conductivity of the starting material.

Example 15

Polyaniline, prepared according to Example 1, is washed with aqueous ammonium hydroxide and then dried. This material, 97.5 g, is combined with 2.5 g xanthan gum and 700 g water and mixed in a Waring TM blender for 4 minutes at high speed. The resulting material is poured into a ball mill jar containing grinding media. The material is predried at 70° C. for 24 hours, sieved through a 710 μm screen, and dried for 17 hours in a vacuum oven at 150° C. The product is compounded into an electrorheological fluid containing 25% solid particles. The fluid exhibits a shear stress of 8.67 kPa and a current density of 336.5 mA/m$^2$ at 20° C. and, at 60° C., 6.39 kPa and 1161 mA/m$^2$. The corresponding measurements for the polyaniline without the xanthan coating are 5.99 and 1278 at 20° C. and 3.66 and 4163 at 60° C.

Example 16

Polyaniline as from Example 1, 45 g, is combined with 5 g xanthan gum and 700 mL distilled water in a Waring TM blender and mixed for 5 minutes. The product is poured into a 4 L beaker and distilled water is added to the 3.5 L mark. One half of the material is placed in a second 4 L beaker and water is added to each portion to the 3.5 L mark. The combined materials are filtered through a large Büchner funnel using a cloth filter. The solids are collected from this filtration and are predried at 70° C., sieved, and vacuum dried at 150° C. The product is compounded into an electrorheological fluid containing 20% solid particles. The fluid exhibits a shear stress of 7.35 kPa and a current density of 551 mA/m$^2$ at 20° C. and, at 60° C., 8.46 kPa and 3070 mA/m$^2$. Comparable measurements for the polyaniline without the xanthan coating, but at a 17% particle concentration, are 7.04 and 1285 at 20° C.

Example 17

Polyaniline as from Example 1, 67.5 g, is combined with 7.5 g xanthan gum and 700 mL distilled water in a Waring TM blender and mixed for 2 minutes at low speed and 2 minutes at high speed. The mixture is poured into pyrex drying dish and dried at 80° C. for 24 hours. The resulting solids are sieved, placed into 3 L of distilled water, and stirred for 63 hours. The resulting mixture is filtered through Whatman TM #1 filter paper in a large Büchner funnel over a period of about 40 hours. Analysis of the filtrate indicates the presence of approximately 0.8 g xanthan gum The solids are collected from this filtration and are vacuum dried at 150° C. and sieved. The product is compounded into an electrorheological fluid containing 25% solid particles. The fluid exhibits a shear stress of 9.44 kPa and a current density of 4146mA/m$^2$ at 20° C. Comparable measurements for the polyaniline without the xanthan coating, but at a 20% solid particle concentration, are 3.33 and 3327.

Example 18

A mixture is prepared of 166 mL concentrated hydrochloric acid and 1.2 L distilled water in a 5 L, 4-neck round bottom flask. To this solution is added 186 g aniline, slowly and with stirring. Thereafter solid xanthan gum, 17.6 g, is added with stirring. The mixture is cooled to 5° C., and 456 g ammonium persulfate is added dropwise over a period of 6 hours, while maintaining the temperature below 10° C. The mixture is stirred for an additional 1.5 hours, then filtered through a cloth filter in a large Büchner funnel. The filtration requires approximately 24 hours. The material isolated is placed in a forced air oven and dried for 24 hours at 70° C. The resulting material is washed by stirring in 2 L of distilled water for 24 hours. The solids are collected by filtration and washed by stirring in a mixture of 330 mL ammonium hydroxide in 6 L water. After washing for about 8 hours the solids are collected by filtration and washed with 2 L distilled water for 24 hours. The material is predried at 70° C. in a forced air oven, sieved, and then dried at 120° C. under vacuum for 8 hours. The product is compounded into an electrorheological fluid containing 20% solid particles. The fluid exhibits a shear stress of 4.21 kPa and a current density of 1040 mA/m$^2$ at 20° C.

Example 19

A. Xanthan gum, 208 g, aniline, 26 g, concentrated hydrochloric acid, 26 g, and distilled water, 13 L, are combined and mixed with a large metal stirring blade at high speed. A viscous gel is obtained. The gel is stirred overnight. Ammonium persulfate, 65 g in aqueous solution, is added dropwise at 2 mL/minute. Stirring is continued overnight. The resulting black, gelled material is poured into pyrex drying dishes and dried for 24 hours at 110° C.

A portion of the resulting black solid is removed from the drying dishes and ball milled dry with grinding media for 8 hours, then further dried for 17 hours at under vacuum at 140° C. The dried product is formulated into an electrorheological fluid containing 60 weight % particles. The fluid, tested in a duct flow apparatus, exhibits a shear stress of 3.2 kPa and a current density of 1044 mA/m$^2$ under 4.5 kV/mm at 20° C.

B. A second portion of the black solid from the initial drying is further washed with base (9.8 mL ammonium hydroxide, diluted in water) for 24 hours and filtered using a large Büchner funnel over a period of several hours. The isolated solid is washed by stirring for 8 hours in 3 L distilled water. The solids are collected by filtration. (The filtrate is analyzed and found to contain 44 g xanthan gum.) The solids are predried at 70° C., vacuum dried at 150° C., and sieved through a 710 μm screen. The dried product is formulated into an electrorheological fluid. The fluid so prepared, containing 35% solid particles, is tested in a duct flow apparatus and exhibits a shear stress of 2.94 kPa and current density of 4166 mA/m$^2$ under 4.5 kV/mm at 20° C.

Example 20

Polyaniline as in Example 1, 48.75 g, and xanthan gum, 1.25 g, are combined in a 1 L flask, with 500 mL distilled water. The components are mixed by vigorous stirring and shaking. The resulting slurry is drawn through a hose of a spray dryer and passed through a spray nozzle at 150° C., then through a glass tube at a temperature of 80° C. Very fine particles are evacuated from the end of the unit. Larger particles settle out separately. The final solid consists of particles with a distribution of sizes. The coated particles are further dried at 120° C. under vacuum and formulated into an electrorheological fluid containing 20% solid particles. The fluid exhibits a shear stress of 7.95 kPa and a current density of 2703 mA/m$^2$ at 20° C.

Example 21

Silicon (99,999%), 95 g, and xanthan gum, 5 g, are combined dry in a Waring TM blender. Distilled water, 500 g, is added and the combination mixed for 2 minutes at slow speed and 2 minutes at high speed. The mixture is poured into a Pyrex TM drying dish and dried for 24 hours in a forced air oven at 80° C. The pre-dried material is passed through a 710 μm screen sieve, than dried for 17 hours under vacuum at 150° C. The product is formulated into an electrorheological fluid containing 45% solid particles. The fluid exhibits a shear stress of 3.1 kPa and a current density of 282 mA/m$^2$ at 20° C. and, at 80° C., 2.33 kPa and 262 mA/m$^2$. The corresponding measurements for the silicon without the xanthan coating are 2.86 and 703 at 20° C.

Example 22

A copolymer of aniline and 2-fluoro-aniline (equimolar amounts), base washed, 27 g is combined with 3 g xanthan gum and 700 mL distilled water. The components are mixed in a Waring TM blender for 2 minutes on slow and 2 minutes on fast. The composition is dried at 70° C. for 24 hours, than at 120° C. under vacuum for 17 hours. The product is formulated into an electrorheological fluid containing 25% solid particles. The fluid exhibits a shear stress of 7.97 kPa and a current density of 1000 mA/m$^2$ at 20° C. and, at 80° C., 3.27 kPa and 434 mA/m$^2$.

Example 23

Cellulose (grade CF11), 142.5 g, potassium chloride, 0.43 g, xanthan gum, 7.1 g, ethylene glycol, 10.0 mL and water, 700 mL, are combined in the pitcher of a Waring TM blender. The materials are mixed for 2 minutes on slow and 2 minutes on fast. The resulting mixture is poured into a Pyrex TM dish and dried in a forced air oven at 110° C. for 24 hours. The dried material is dry ground in a ball mill, then further dried for 17 hours under vacuum at 140° C. The product is formulated into an electrorheological fluid containing 30% solid particles. The fluid exhibits a shear stress of 1.78 kPa and a current density of 3.55 mA/m$^2$ at 20° C. and, at 80° C., 3.07 kPa and 6.74 mA/m$^2$.

Example 24

A zeolite, Mordenite EZ-350 from Englehard, 100 g, is combined with xanthan gum, 4 g, water, 700 mL, and ethylene glycol, 2 g, in a Waring blender. The composition is mixed for 2 minutes on slow and 2 minutes on fast, then poured into a Pyrex TM dish and dried in a forced air oven for 24 hours. The solids are sieved through a 710 μm screen, dried for 17 hours under vacuum at 150° C., and formulated into an electrorheological fluid. The fluid so prepared is subjected to the screening test described in Example 19. No gross amounts of fluid are retained on the electrodes. It is believed that more sensitive measurements will detect electrorheological activity.

Example 25

Chromic oxide ($Cr_2O_3$), 95 g, xanthan gum, 5 g, and water, 700 mL, are combined in a Waring TM blender and mixed for 5 minutes. The mixture is poured into a Pyrex TM dish and placed into a forced air oven at 70° C. to dry. The dried material is sieved and further dried under vacuum at 150° C. The material is formulated into an electro-rheological fluid. The fluid so prepared is subjected to the screening test of Example 19. No gross amounts of fluid are retained between the electrodes. It is believed that more sensitive measurements will detect electrorheological activity.

Example 26

A maleic anhydride-styrene copolymer as described in copending U.S. application Ser. No. 07/878,797, filed Apr. 1, 1992, equivalent to PCT application PCT/US93/03223, filed Apr. 5, 1993,neutralized by sodium hydroxide, 83 g, is combined with xanthan gum, 5 g, ethylene glycol, 12 g, and distilled water, 1 L, in a Waring TM blender. The combination is mixed for 90 seconds. The water is removed by evaporation in a drying dish in a forced air oven, the solids passed through a 710 μm sieve, and the resulting solids further dried for 17 hours under vacuum at 150° C. The product is formulated into an electrorheological fluid containing 40% solid particles. The fluid exhibits a shear stress of 4.97 kPa and a current density of 9.9 mA/m$^2$ at 20° C. and, at 80° C., 5.31 kPa and 121 mA/m$^2$.

Example 27

Example 1 is substantially repeated using in place of the xanthan gum, each of the following materials in turn:

(a) glycogen
(b) pectin
(c) agar
(d) carboxymethylcellulose
(e) gum arabic
(f) guar gum
(g) gum tragacanth
(h) agar
(i) carrageenan
(j) gellan gum (k) rhamsan gum (l) welan gum.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. An electrorheological fluid comprising a hydrophobic liquid phase and, dispersed therein, electrorheologically active particles comprising an electrorheologically active core particle and a coating of at least one polysaccharide which is dispersible in a protic medium.

2. The electrorheological fluid of claim 1 wherein the polysaccharide is a gum.

3. The electrorheological fluid of claim 2 wherein the gum is a polymeric material having metal neutralized acid groups.

4. The electrorheological fluid of claim 3 wherein the gum has a melting point of at least about 140° C. and a molecular weight of about $5\times10^5$ to about $5\times10^6$.

5. The electrorheological fluid of claim 2 wherein the gum is xanthan gum.

6. The electrorheological fluid of claim 1 wherein the coating comprises about 1 to about 40 percent by weight of the electrorheologically active particles.

7. The electrorheological fluid of claim 1 wherein the coating comprises about 2 to about 20 percent by weight of the electrorheologically active particles.

8. The electrorheological fluid of claim 1 wherein the coating comprises about 3 to about 15 percent by weight of the electrorheologically active particles.

9. The electrorheological fluid of claim 1 wherein the core particle is conductive or semiconductive.

10. The electrorheological fluid of claim 9 wherein the core particle is capable of exhibiting electrorheological activity when substantially anhydrous.

11. The electrorheological fluid of claim 1 wherein the core particle is a polymeric material.

12. The electrorheological fluid of claim 11 wherein the polymeric material is an aniline homopolymer or copolymer.

13. The electrorheological fluid of claim 1 wherein the amount of particles in the fluid is about 5 to about 60 percent by weight of the fluid.

14. The electrorheological fluid of claim I wherein the particles have a number average size of about 0.25 to about 100 micrometers.

15. The electrorheological fluid of claim 1 further comprising a dispersing agent in an amount sufficient to improve the dispersion of the particles.

16. The electrorheological fluid of claim 15 wherein the dispersing agent is a functionalized silicone.

17. The electrorheological fluid of claim 1 wherein the hydrophobic liquid phase is selected from the group consisting of silicone oils, mineral oils, vegetable oils, aromatic oils, naphthalene hydrocarbons, olefin hydrocarbons, chlorinated paraffins, synthetic esters, hydrogenated olefin oligomers, and mixtures thereof.

18. The electrorheological fluid of claim 17 wherein the hydrophobic liquid phase is a silicone oil.

19. The electrorheological fluid of claim 1 wherein the hydrophobic liquid phase is selected from the group consisting of transformer oils.

20. The electrotheological fluid of claim 1 wherein the hydrophobic liquid phase is selected from the group consisting of paraffin hydrocarbons.

21. An electrotheological fluid prepared by admixing with a hydrophobic liquid phase, particles having been treated to reduce the electrical conductivity thereof by the steps of:

(a) combining the particles, a polysaccharide which is dispersible in a protic medium, and a sufficient amount of a protic medium to disperse the polysaccharide and provide a slurry, and (b) removing substantially all of the protic medium to provide a solid.

22. A clutch, valve, shock absorber, or damper containing the electrorheological fluid of claim 1.

23.The electrorheological fluid of claim 1 wherein the polysaccharide is soluble in said protic medium.

24. The electrorheological fluid of claim 1 wherein the polysaccharide coating serves to reduce the conductivity of the fluid.

* * * * *